United States Patent [19]

Byers, Sr. et al.

[11] Patent Number: 4,971,479

[45] Date of Patent: Nov. 20, 1990

[54] POST DRIVER

[75] Inventors: Alvin H. Byers, Sr., Humble; Clayton F. Brooks, Channelview, both of Tex.

[73] Assignee: Southwestern Bell Telephone Company, St. Louis Mo.

[21] Appl. No.: 141,383

[22] Filed: Dec. 14, 1987

Related U.S. Application Data

[63] Continuation-in-part of Ser. No. 934,414, Nov. 24, 1986, abandoned.

[51] Int. Cl.[5] ..... B23B 45/16; B25D 1/00

[52] U.S. Cl. ..... 405/232; 405/231; 173/129; 173/130

[58] Field of Search ..... 405/231, 232; 52/155, 52/165; 173/90, 128, 129, 130, 131, 132, 133

[56] References Cited

U.S. PATENT DOCUMENTS

| | | | |
|---|---|---|---|
| 55,586 | 6/1866 | McClay | 173/90 |
| 900,140 | 10/1908 | Whitehill | 173/132 |
| 3,242,997 | 3/1966 | Tokola | 173/131 |
| 3,454,113 | 7/1969 | Holtz | 173/129 |
| 3,499,497 | 3/1970 | Moore | 405/232 X |
| 4,298,075 | 11/1981 | Sweeney | 173/129 |
| 4,494,612 | 1/1985 | Bell | 173/129 X |
| 4,641,715 | 2/1987 | Stinson et al. | 173/129 |

OTHER PUBLICATIONS

"2 plus 2 Post Driver/Puller", advertising circular, The Porter Company; date, unknown.

*Primary Examiner*—Dennis L. Taylor
*Assistant Examiner*—J. Russell McBee
*Attorney, Agent, or Firm*—Sandler, Greenblum & Berstein

[57] ABSTRACT

A post driver for inserting or removing marker posts into the ground. The driver comprises two components, the hammer and the bracket, which cooperate in a safe and efficient means for installing and removing marker posts. The hammer locks around the post and the bracket attaches to the vertically aligned holes which are located on the face of the post.

21 Claims, 4 Drawing Sheets

POST DRIVER

BACKGROUND OF THE INVENTION

This is a continuation-in-part of Ser. No. 934,414, filed Nov. 24, 1986 now abandoned.

I. Field of the Invention

The invention is related to a means of driving marker posts into the ground. Specifically, it is related to a method and device which drives and removes channeled marker posts that will later contain informational signage.

II. Description of the Prior Art

Marker posts or poles are traditionally used to provide the public with information regarding location, danger, instruction, or information. The posts are usually 10-12 feet long and have u-shaped channels to provide structural strength. Along the length of the channel are ⅜ inch diameter holes on one inch centers. Signs are attached to the posts by bolting the sign through the channel holes at the desired height.

The conventional method of driving such marker posts into the ground is by applying a force to the top of the post. The post is located at the desired spot and the installer climbs a ladder with his driving implement to pound the post approximately 3 feet into the ground. If the driving implement is a sledge hammer then a second worker must hold the post. If the implement is a driver which has a hood for covering the top of the post then one man can pound in the post. These devices can lead to accidents and fatigue since the installer is either working on a ladder or lifting the driving tool over his head. It is difficult to maintain control of the post with these methods and devices.

A problem also exists with respect to removal of marker posts. Removal is usually accomplished by attaching a chain between the post and a backhoe or truck and pulling the post from the ground. Since expensive equipment and much manpower is required, this method of removing a post is very expensive. Frequently, the posts are damaged during this operation.

In summary, there is no device and method available for both the insertion and removal of marking posts. The devices of the prior art cannot be used to remove a post from the ground. Also, their use can pose both safety and control problems.

It is an object of the present invention to provide a means and a method for inserting marker posts into the ground and removing them. A feature of this method is that it is both safe and effective. It is inexpensive and does not damage the post so that it can be later reused. Other features of the invention include that a post can be installed by one man without endangering himself and that the hammer is secured to the pole to enable maximum force to be applied safely to the bracket.

SUMMARY OF THE INVENTION

The invention is directed to a device for installing and removing marker posts which have a series of vertically aligned holes. The device comprises a hammer means that substantially surrounds the marker post and a bracket means which attaches to the post through the vertically aligned holes and forms a striking surface for the hammer.

The invention is also directed to a method for installing and removing marker posts having a series of vertically aligned holes. The method comprises affixing a bracket to the post through the holes, surrounding the post with a hammer, and striking the bracket with a hammer.

DESCRIPTION OF THE PREFERRED EMBODIMENTS

Figure 1:
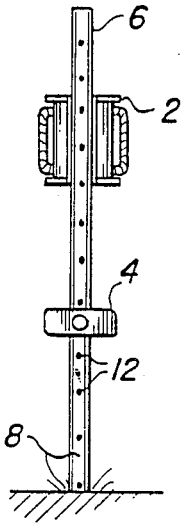
FIG. 1 is a pictorial view showing the use of the invention for driving the marker post into the ground.
Figure 2:
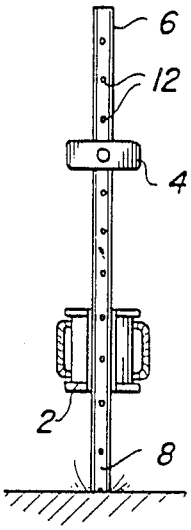
FIG. 2 is a pictorial view showing the use of the invention for removing a marker post from the ground.

Referring to FIGS. 1 and 2 it is seen that the invention comprises a hammer assembly 2 and a bracket assembly 4. The bracket assembly 4 fixedly attaches to the post 6. The post 6 is typically twelve feet long and 3½ inches wide with a protruding u-shaped front 8. The protruding front 8 extends approximately 1½ inches from the post's back wall 10 and has drilled a series of ⅜ inch holes 12 on 1 inch centers vertically aligned down the front of the post 6.

Figure 3:
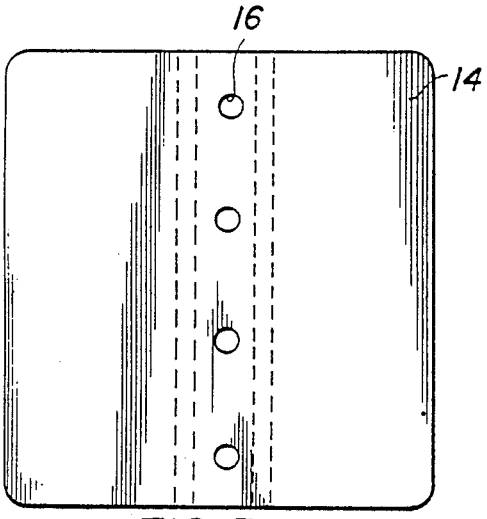
FIG. 3 is a front view of the plate which forms the front of the bracket assembly of the invention.
Figure 5:
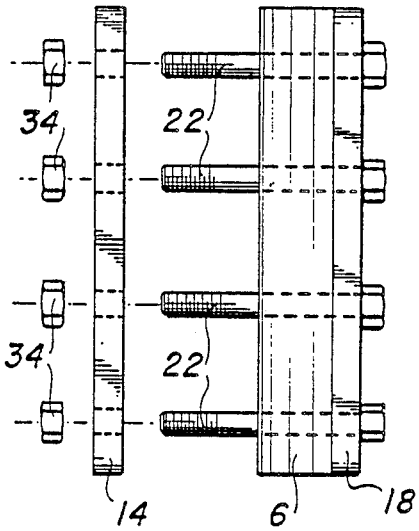
FIG. 5 is a side view showing the attachment of the back of the bracket assembly of the invention to the front of the bracket assembly of the invention.
Figure 4:
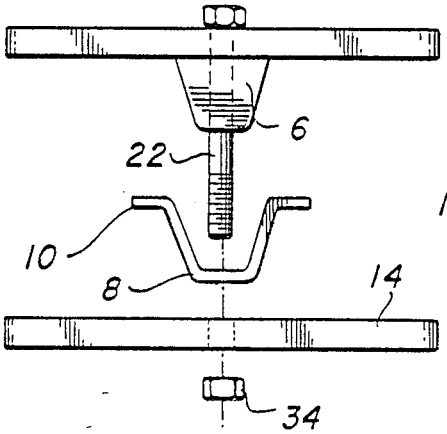
FIG. 4 is a top view of the bracket assembly of the invention and a marker post.
Figure 6:
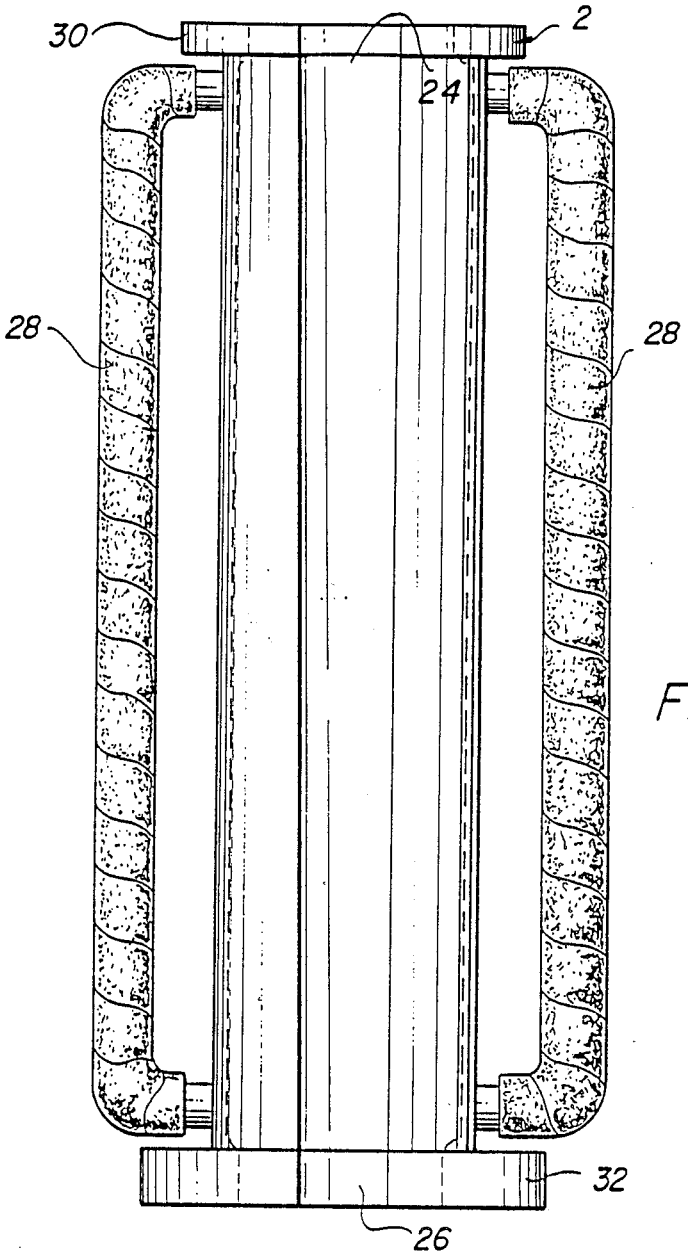
FIG. 6 is a side view of the hammer assembly of the present invention.
Figure 7:
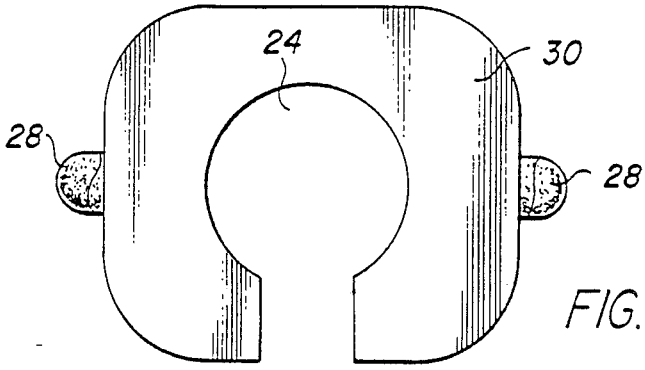
FIG. 7 is a top view of the hammer assembly of the present invention.
Figure 8:
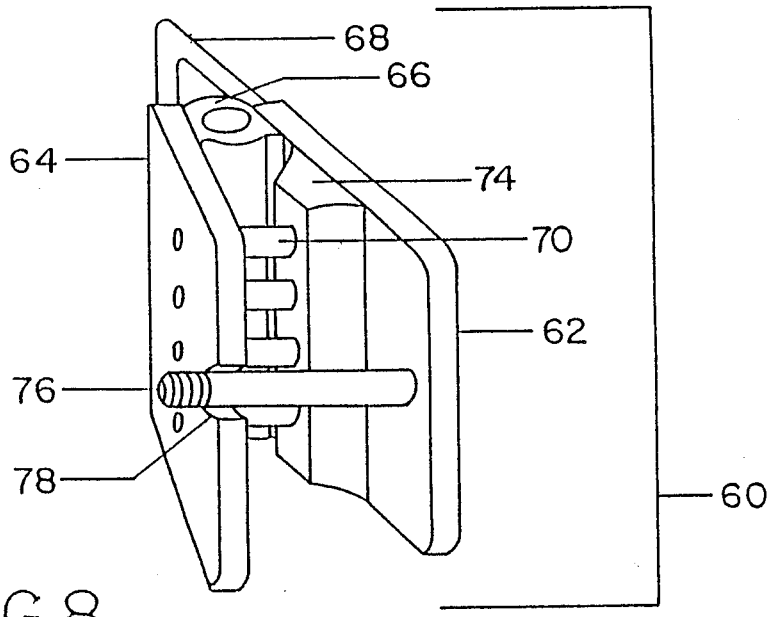
FIG. 8 is an alternative embodiment of the bracket assembly of the invention.
Figure 9:
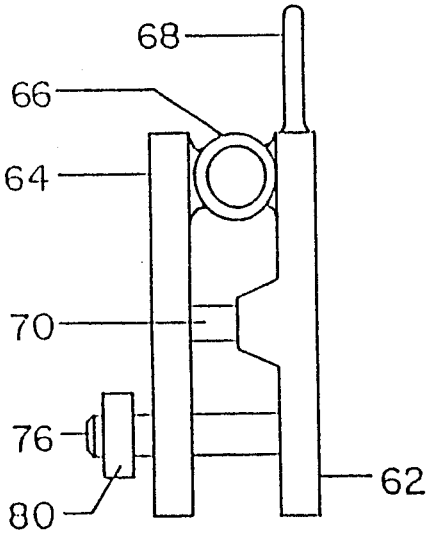
FIG. 9 is a side view of the alternative embodiment of the invention.
Figure 10:
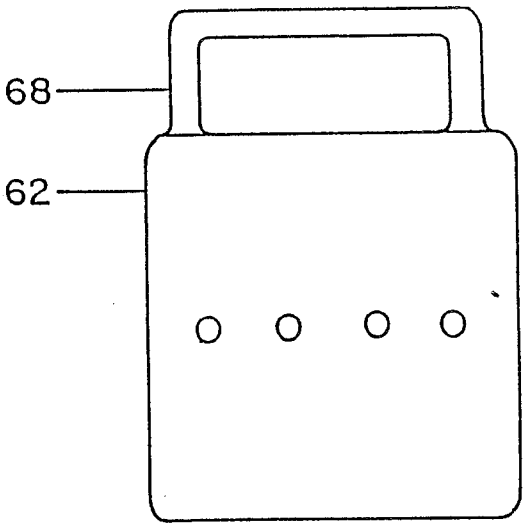
FIG. 10 is a bottom view of the alternative embodiment of the invention.
Figure 11:
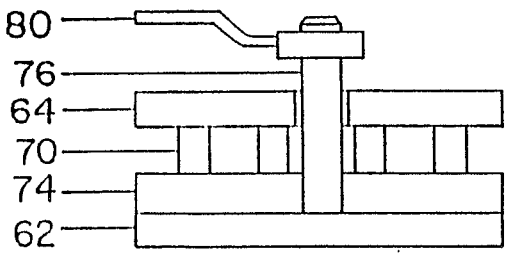
FIG. 11 is a front view of the alternative embodiment of the invention.
Figure 12:
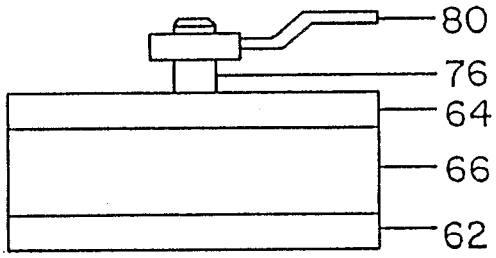
FIG. 12 is a back view of the alternative embodiment of the invention.
Figure 13:
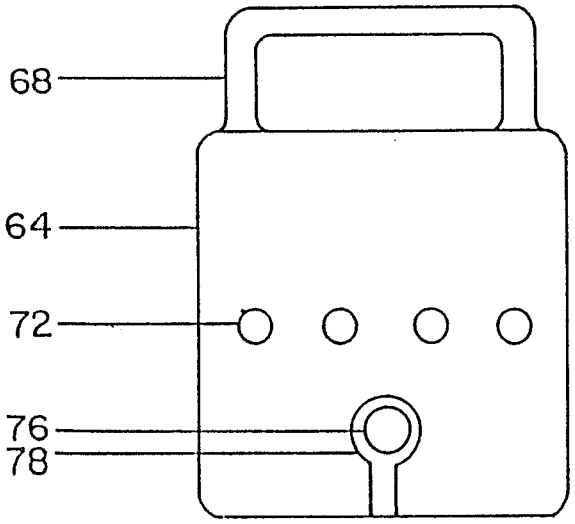
FIG. 13 is a top view of the alternative embodiment of the invention.

As shown in FIGS. 3, 4 and 5 the bracket assembly 4 is comprised of two main sections. The front plate 14 of bracket assembly 4, if flat, measures approximately 7½ inches × 7½ inches. The plate 14 has a series of vertically aligned ⅜ inch holes 16 which are on two inch centers. The plate 14 is approximately ½ inch thick.

The rear plate 18 is a substantially flat 7½ in. × 7½ in. metal plate with a u-shaped protrusion 20 that matches the shape of the post's protruding front 8. Mounted vertically on the plate protrusion 20 are series of ⅜ inch aircraft nine point hardened steel bolts 22 which are on 2 inch centers. The bolts 20 are aligned with the post holes 12 and front plate holes 16. The ≡-shaped protrusion 20 is necessary in order to avoid a shearing of the bolts 22 during pounding.

The hammer 2 is a solid metal block with a hollowed center section 24. The center section 24 is approximately 3½ inches in diameter. Leading to the center section 24 is a passage or opening 26 which is approximately 1¾ inches wide. The opening 26 allows the post 6 to pass into the center section 24.

The hammer 2 also has handles 28 and striker plates 30 and 32. The top plate 30 is approximately ½ inch thick and bottom plate 32 is almost 1 inch wide. The thicker bottom or striker plate 32 is used to strike the bracket assembly 4. The total length of the hammer assembly 2 is approximately 20 inches and contains a pair of handles 34.

To pound a post 6 into the ground, the bracket assembly 4 is attached to the post. First, the bolts 22 of the rear plate 18 are aligned with the rear of the holes 12 at waist height. The bolts 22 are passed through the holes 12 and through the corresponding holes 16 of front plate 14. Lock washers and bolts 34 are then tightened on bolts 22. The bracket assembly is complete.

The hammer assembly 2 is slipped onto the post 6 above the bracket assembly 4. The edge of the post 6 is passed through the opening 26 and into the center section 24. The hammer is rotated so that the opening 26 is aligned with the bolts 22 which locks the post 6 into the center section 24. The hammer bottom plate 32 is adjacent to the bracket assembly 4, as shown in FIG. 1. It should be noted that the hammer 2 is locked onto the post 6 and will only hammer onto the bracket assembly 4.

The post 6 is held upright. The installer then lifts the hammer assembly 2 by handles 28 approximately 18 inches and allows it to fall on the bracket assembly 4. This action provides the necessary force to drive the post 6 into the ground. After repeated blows the post will be driven to its desired depth and the hammer is removed by twisting it sideways and passing the post edge through the opening 26. The bracket assembly 4 is removed by unbolting the front plate 14 from bolts 22. A marker sign is then bolted to the post 6.

To remove post 6 from the ground the bracket assembly 4 is bolted to the post 6 at waist height. The hammer assembly 2 is affixed to the post as described above. However, as shown in FIG. 2, the hammer assembly 2 is placed below the bracket assembly 4. The hammer plate 32 is adjacent to the bottom of the bracket assembly 4. To remove the post 6, the hammer assembly 2 is lifted upward against bracket assembly 4 with striking force. After repeated blows, the post 6 will be driven out of the ground and the hammer assembly 2 and the bracket assembly 4 can be removed as described above.

FIG. 8–13 illustrates an alternative embodiment of the bracket assembly. The alternative bracket assembly 60 has a back plate 62 which is hinged to a front plate 64. The hinge 66 allows the front plate 64 to move outward from the back plate 62.

The back plate 62 also contains a handle 68 and a set of pins 70. The pins 70 correspond to the holes on the front plate 72. The pins 70 are mounted on a surface 74 which corresponds in shape to the post's protruding front 8. The back plate 62 also contains a threaded locking pin 76 which is aligned with a cut out opening 78 on the front plate 64.

To place the bracket assembly 60 on the post 6, the plates 62 and 64 are separated. The pins 70 are placed through the post holes 12 from the rear. The plate 64 is closed over the pins 70 and a locking bolt 80 is threaded onto locking pin 76. The locking bolt is tightened until the plates 62 and 64 are snug against post 6.

The present invention provides a means of both driving and removing a marker post. The method and device are cost effective and require no maintenance. Unlike other devices, the invention allows the placing or removing of posts in places where there is limited access for machinery.

The device is safer to use than devices of the prior art since all of the work is performed at eye level. With both hands on the driver the injury to hands and fingers is reduced. Due to the unique construction of the device it can be operated by one man regardless of his size.

We claim:

1. A device for installing and removing U-shaped posts, said device comprising:
   (a) a bracket with securing means for removably mounting the bracket on a post having a periphery, said bracket including a surface which substantially surrounds and extends outwardly from the periphery of the post; and
   (b) a hammer adapted to be reciprocally movable along the post, said hammer having a striking surface substantially surrounding the post so as to contact the surface of said bracket.

2. The device according to claim 1, wherein said bracket includes a front plate and a back plate.

3. The device according to claim 2, further comprising hinge means for connecting said front plate to said back plate.

4. The device according to claim 3, further comprising a locking bolt for holding said front plate and back plate.

5. The device according to claim 2, wherein said post includes a series of vertically aligned holes and one of said back plate and front plate includes at least one pin for insertion in a corresponding hole.

6. The device according to claim 5, one of said back plate and front plate comprising a series of vertically aligned pins corresponding to said series of vertically aligned holes.

7. The device according to claim 5, wherein the other of said front plate and back plate includes at least one hold that corresponds to said at least one pin.

8. The device according to claim 5, wherein said bracket includes a protrusion adapted to fit into a channel of the U-shaped post.

9. The device according to claim 8, wherein said at least one pin is mounted on said protrusion.

10. The device according to claim 2, wherein said post includes a series of vertically aligned holes and one of said back plate and front plate includes at least one bolt for insertion in a corresponding hole.

11. The device according to claim 10, wherein the other of said back plate and front plate includes at least one hole to receive a corresponding bolt.

12. The device according to claim 1, wherein said hammer includes a hollow center section and an opening extending along the entire longitudinal length of said hammer, said opening comprising means for allowing the post to extend into said hollow center section.

13. The device according to claim 1, wherein said hammer includes at least one handle.

14. A method for installing and removing a U-shaped post, said method comprising the steps of:
   (a) substantially surrounding and affixing a bracket to the post, wherein said bracket presents a surface extending outwardly from the periphery of the post;
   (b) substantially surrounding the post with a hammer having a striking surface adapted to contact said surface of said bracket; and
   (c) striking said bracket with said hammer.

15. The method according to claim 14, wherein the bracket is affixed to said post by placing a front plate and a back plate on opposite sides of the post.

16. The method according claim 15, wherein said post includes a series of vertically aligned holes, and at least one pin on one of said front plate and back plate are inserted into at least one of said holes.

17. The method according to claim 15, further comprising the step of connecting said front plate and back plate with a hinge.

18. The method according to claim 15, wherein said post includes a series of vertically aligned holes, and at least one bolt on said front and back plate is inserted into at least one of said holes.

19. The method according to claim 14, wherein said hammer includes a hollow center section and an opening extending along the entire longitudinal length of said hammer, said method further comprising passing the post through the opening into the hollow center section.

20. The method according to claim 19, wherein the width and thickness of the post have different dimensions, the width of the opening being slightly larger than the smaller dimension, said method further comprising rotating the hammer about a vertical axis after the post is in said hollow center section.

21. The method according to claim 14, wherein said striking surface of said hammer strikes said surface of said bracket.

* * * * *

UNITED STATES PATENT AND TRADEMARK OFFICE

CERTIFICATE OF CORRECTION

PATENT NO. : 4,971,479
DATED : November 20, 1990
INVENTOR(S) : BYERS, Sr. et al.

It is certified that error appears in the above-indentified patent and that said Letters Patent is hereby corrected as shown below:

At column 2, line 60, change "≡" to ---u---.

At column 4, line 38 (claim 7, line 3), change "hold" to ---hole---.

Signed and Sealed this

Thirty-first Day of January, 1995

Bruce Lehman

*Attest:*

BRUCE LEHMAN

*Attesting Officer*

*Commissioner of Patents and Trademarks*